US007275981B1

(12) United States Patent
Hurt et al.

(10) Patent No.: US 7,275,981 B1
(45) Date of Patent: Oct. 2, 2007

(54) SYMMETRICAL WALL SANDER

(76) Inventors: Ronald B. Hurt, 11276 Brant Ct., Becker, Sherburne, MN (US) 55308; Cheryl F. Hurt, 11276 Brant Ct., Becker, Sherburne, MN (US) 55308; Curtis R. Sauer, 504 5th St. North, Sartell, Stearns, MN (US) 56377; Allen A. Retzer, 7960 S. Bay Curve, Eden Prarie, MN (US) 55347

( * ) Notice: Subject to any disclaimer, the term of this patent is extended or adjusted under 35 U.S.C. 154(b) by 95 days.

(21) Appl. No.: 11/032,824

(22) Filed: Jan. 10, 2005

Related U.S. Application Data

(60) Provisional application No. 60/535,376, filed on Jan. 9, 2004.

(51) Int. Cl.
*B24B 23/00* (2006.01)

(52) U.S. Cl. ..... 451/524; 451/557

(58) Field of Classification Search ..... 451/557, 451/524, 525, 344, 523, 558; 403/122, 114, 403/115

See application file for complete search history.

(56) References Cited

U.S. PATENT DOCUMENTS

| | | | | | |
|---|---|---|---|---|---|
| 135,771 | A * | 2/1873 | Burtch | 254/112 |
| 1,501,192 | A | 7/1924 | Severns | |
| 2,434,581 | A | 1/1948 | Ottoson | |
| 2,663,979 | A | 12/1953 | Sierchio | |
| 2,711,059 | A | 6/1955 | Ames | |
| 2,753,669 | A | 7/1956 | Larson | |
| 2,817,931 | A | 12/1957 | Houser | |
| 3,123,946 | A | 3/1964 | Hoveland | |
| 3,279,130 | A | 10/1966 | Nelson | |
| 3,483,662 | A | 12/1969 | Ames | |
| 4,663,796 | A | 5/1987 | Helling et al. | |
| 4,885,876 | A | 12/1989 | Henke | |
| 5,036,627 | A | 8/1991 | Walters | |
| 5,144,774 | A | 9/1992 | Conboy | |
| 5,301,472 | A | 4/1994 | Lyng | |
| 5,392,569 | A | 2/1995 | Stickle | |
| 5,551,115 | A * | 9/1996 | Newville | 15/172 |
| 5,709,597 | A | 1/1998 | Sarantitis | |
| 5,895,316 | A * | 4/1999 | Williams | 451/524 |
| 5,954,571 | A | 9/1999 | Case | |
| 6,053,805 | A * | 4/2000 | Sanchez | 451/456 |
| 6,200,205 | B1 * | 3/2001 | Yiu | 451/178 |
| 6,325,708 | B1 | 12/2001 | Miles | |
| 6,409,413 | B1 * | 6/2002 | Bieg et al. | 403/115 |
| 6,524,175 | B2 | 2/2003 | Beaudry et al. | |
| 6,659,852 | B1 * | 12/2003 | Wettstein et al. | 451/557 |

OTHER PUBLICATIONS

"Porter-Cable 7800Variable Speed Drywall Sander", http://www.coastaltool.com/cgi-bin/SortCart.exe/a/port/pr7800.htm?E+coastest. Dec. 10, 2003, 2 pages, Coastal Tool & Supply, West Hartford, CT.

* cited by examiner

*Primary Examiner*—Jacob K. Ackun, Jr.
(74) *Attorney, Agent, or Firm*—Albert W. Watkins

(57) ABSTRACT

A disc-shaped sanding pad has a round perimeter. Centrally located in the pad is a socket. A ball, coupled to the end of a handle, is inserted into the socket, permitting the sanding pad to both pivot and rotate freely about the handle. A second single axis pivot is also provided in the preferred embodiment between the handle and sanding pad, which permits the handle to traverse an area greater than a hemisphere about the sanding pad socket.

9 Claims, 2 Drawing Sheets

SYMMETRICAL WALL SANDER

CROSS REFERENCE TO RELATED APPLICATIONS

This application claims priority to U.S. provisional patent application Ser. No. 60/535,376, filed Jan. 9, 2004 and co-pending herewith, entitled "Symmetrical Sander" and naming the same inventors as the present application, the contents which are incorporated herein by reference in entirety.

BACKGROUND OF THE INVENTION

1. Field of the Invention

This invention pertains generally to abrading, and more particularly to wall surfacing sanders having a circular plate-like sandpaper holder manipulated at the end of an elongated handle.

2. Description of the Related Art

In the building construction and restoration trades, the finishing of walls will most preferably be completed with adequate care and precision so as to not reveal the various components used in the construction of the wall, nor their intersections, junctions and overlaps. More particularly, it is common practice to apply special tapes across abutted sheets of drywall or the like, and then apply thin layers of plaster, spackling compound or the like, depending upon the sheet material and application, over the tapes to smooth the transitions therebetween. Similarly, during repair and reconstruction, cracks or holes that require patching and repair will also be filled and smoothed to the surrounding wall. As a necessary part of the process, there will commonly exist a need to sand large areas of a wall. In some instances, once sanding has been completed, there will be revealed an additional need for plaster, spackling compound or the like, leading to a second round of applying the material and subsequent sanding.

These wall regions are very frequently located beyond comfortable reach. Consequently, sanding operations have heretofore involved either the use of ladders, with the requisite repositioning of the ladder for every few feet of wall to be sanded, the use of scaffolding which is both difficult to set up and which may interfere with access to a portion of the wall, or the use of special pole-mounted sanders that may be manipulated from the ground. Given the choices, at first blush to those less familiar with the operations, it might seem obvious to use the pole-mounted sanders. The pole permits a sander to travel along the ground and reach walls at great distances from the ground.

Consequently, a person may simply walk about, without climbing up and down ladders, and through "sweeping" motions, sand the wall. Since the person is already on the ground, replacement of sandpaper and the like is easy, as is access to other supplies, refreshments, and any other necessities required by the sander through the day.

Unfortunately, heretofore there have been several consequential drawbacks to pole-mounted sanders. One disadvantage has been a tendency for the sanding block to flip from the sanding surface over to the backing plate. As can be immediately understood, when the sanding block directly contacts the wall, there may be both undesirable material removal from the wall and also marking or material transfer from the block to the wall. Such an event may easily occur, owing to the length and natural flexibility of the pole, and difficulties with manipulating the sanding block smoothly over the surface. The surface may, of course, additionally be irregular or rough, further complicating the motion of the sanding block. When the block flips, the wall will require both patching and sanding. This can be particularly frustrating when an area was already essentially finished. Consequently, one false move may set the sander back several hours, and may require a return trip on a different day, after the wall material has had sufficient time to once again dry and harden. To make matters worse, a person must have a reasonable amount of strength and dexterity to manipulate the pole. While early in the work day this may be very routine, later in the day, just when the job is to be finished, the sander may be sufficiently exhausted to be more prone to the very mistakes in manipulation that will lead to the flipping of the sander and resultant wall damage.

A second disadvantage pertains to the geometry of most pole-mounted wall sanders. These have heretofore primarily used a rectangular sanding pad, which facilitates the sanding of an edge or straight line. However, it is very easy to run the rectangular pad along the same path too many times, thus forming a sanding groove. As those familiar with power sanding will recognize, orbital sanders were developed specifically to reduce the chance of forming sanding grooves.

A third disadvantage of the prior art pole sanders exists when a sander applies uneven pressure to the pole. This may be from twisting the pole, or the direction and motion required to reach a difficult-to-access place, or for other reason. Such uneven pressure may cause the undesirable flipping, but may alternatively lead to an uneven biting or digging into the relatively softer wall material. Once again, rather than blending the surfaces together, such uneven forces will tend to produce troughs or marks in the wall that only worsen the overall appearance.

While many of the foregoing disadvantages may be overcome using various apparatus and techniques, the opportunity to practically apply such apparatus and techniques just does not exist.

As but one example, a larger sanding pad will be less prone to flipping. However, the wall sander is at the end of a long pole, and the actual sanding block must therefore not be too heavy. From an understanding of physics, we can appreciate that while a one pound object directly held may seem to be relatively light, when it is at the end of a long pole, the forces necessary to move it about will be amplified by the relative distances between hands and to the end of the pole. This will make a weight at the end of a long pole seem to be much more. Consequently, while larger sanding blocks will be less inclined to flip, the additional weight may make them unmanageable for an entire work shift or day. Furthermore, the amount of force per square inch of sanding surface area that is necessary for the sanding operation to proceed effectively will be distributed over a larger area, thus again increasing the amount of total force, or muscle-power, that must be applied by the operator at the end of the pole. Once again, this extra effort will be required throughout the day, and will lead to undesirable fatigue for many persons.

Exemplary of the prior art is U.S. Pat. No. 6,524,175 to Beaudry et al, the contents which are incorporated herein by reference for the relevant teachings. Beaudry et al illustrates the standard prior art rectangular pad, which may be attached to either a hand grip or to a pole. The pole is disclosed as being coupled through either a universal joint or a ball and socket, though the ball and socket is not illustrated. Nevertheless, and as described herein above, the rectangular geometry of the sanding block is actually quite dangerous to be used with a ball and socket, since the sanding forces will readily concentrate at the corners of the pad, and, with a ball and socket, may not be countered by manual forces upon the pole. Said another way, if a corner of the sanding block starts to bite into the wall, which will certainly damage the wall and which could lead to the pad flipping, an operator will not be able to simply twist his grip with the ball and socket, since a ball and socket joint will not transfer such forces to the pad. Consequently, the universal joint illustrated by Beaudry et al and similarly in the other prior art, which permits controlled twisting of the pad, has been much preferred over a ball and socket.

U.S. Pat. No. 5,144,774 by Conboy, the teachings which are incorporated herein by reference, illustrates a ball and socket between head and handle, but with rotation preventing grooves in the ball and keys in the socket. U.S. Pat. No. 4,663,796 by Helling et al, the teachings which are also incorporated herein by reference, illustrates a quick-release handle that is attached to the male threaded pole by a female thread. Additional patents, the teachings of each which are further incorporated herein by reference, include U.S. Pat. Nos. 1,501,192 by Severns; 2,434,581 by Ottoson; 2,663,979 by Sierchio; 2,711,059 by Ames; 2,753,669 by Larson; 2,817,931 by Houser; 3,123,946 by Hoveland; 3,279,130 by Nelson; 3,483,662 by Ames; 4,885,876 by Henke; 5,036,627 by Walters; 5,301,472 by Lyng; 5,392,569 by Stickle; 5,709,597 by Sarantitis; 5,954,571 by Case; 6,053,805 by Sanchez; and 6,325,708 by Miles. Nevertheless, these documents fail, either singly or in combination, to overcome the limitations outlined herein above. What is desired then is a pole-mounted sander which overcomes the many disadvantages of prior art pole sanders.

SUMMARY OF THE INVENTION

In a first manifestation, the invention is, in combination, a sanding block having at least one sanding surface with a generally round perimeter; a ball; a socket coupled to the ball and operative therewith as a first pivoting joint; and a handle coupling operative to couple with an elongated pole for manipulation by a person.

In a second manifestation, the invention is a wall sander. The wall sander has an elongated pole coupled to a handle receiver. A generally planar sanding plate operative to supporting sanding paper thereon and having a generally circular perimeter is pivotally coupled through a joint to the handle about a single point of rotation, thereby permitting relative rotation about an axis of any orientation.

In a third manifestation, the invention is a hand-manipulated wall sanding apparatus having a sandpaper support, an extension, and a means for permitting both rotary and angular translation of the sandpaper support about the extension.

OBJECTS OF THE INVENTION

Exemplary embodiments of the present invention solve inadequacies of the prior art by providing a disc-shaped sanding pad having a round perimeter in combination with a centrally located socket. A ball, coupled to the end of a handle, is inserted therein, permitting the round sanding pad to pivot and rotate freely about the handle.

A first object of the invention is to provide a wall sanding apparatus which will pivot or rotate rather than flip or gouge the wall during use. A second object of the invention is to enable movement of the handle throughout an entire hemisphere about the sanding block and socket, thereby permitting sanding on a surface parallel to the handle. Another object of the present invention is to provide a relatively small and lightweight pole sanding block, which does not demand significantly greater manipulation force when compared to prior art sanding blocks. A further object of the invention is to enable precise sanding along edges, with controlled sanding patterns that are designed to not form grooves or tracks in the wall, while still sanding immediately adjacent to the edge. An even further object of the invention is to provide free movement of the sanding pad about a coupling, to both spin and pivot, while only coupling forces from the operator to the sanding pad which move the pad into or from contact with a wall, and which will change the location of the center of the pad relative to the wall. Yet another object of the present invention is to provide the foregoing with a minimum of parts and cost, thereby further facilitating the adoption of the sanding tool in the industry. An ancillary object of the invention, which may be attained through the achievement of the foregoing objectives, is the replacement of the myriad of hand sanding blocks, sanding sponges, many different shapes and dimensions of sand paper, and other sanding tools that have heretofore been required for efficient sanding, with the single symmetrical wall sander of the present invention, most preferably having pad size common to that used most frequently with power sanders.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
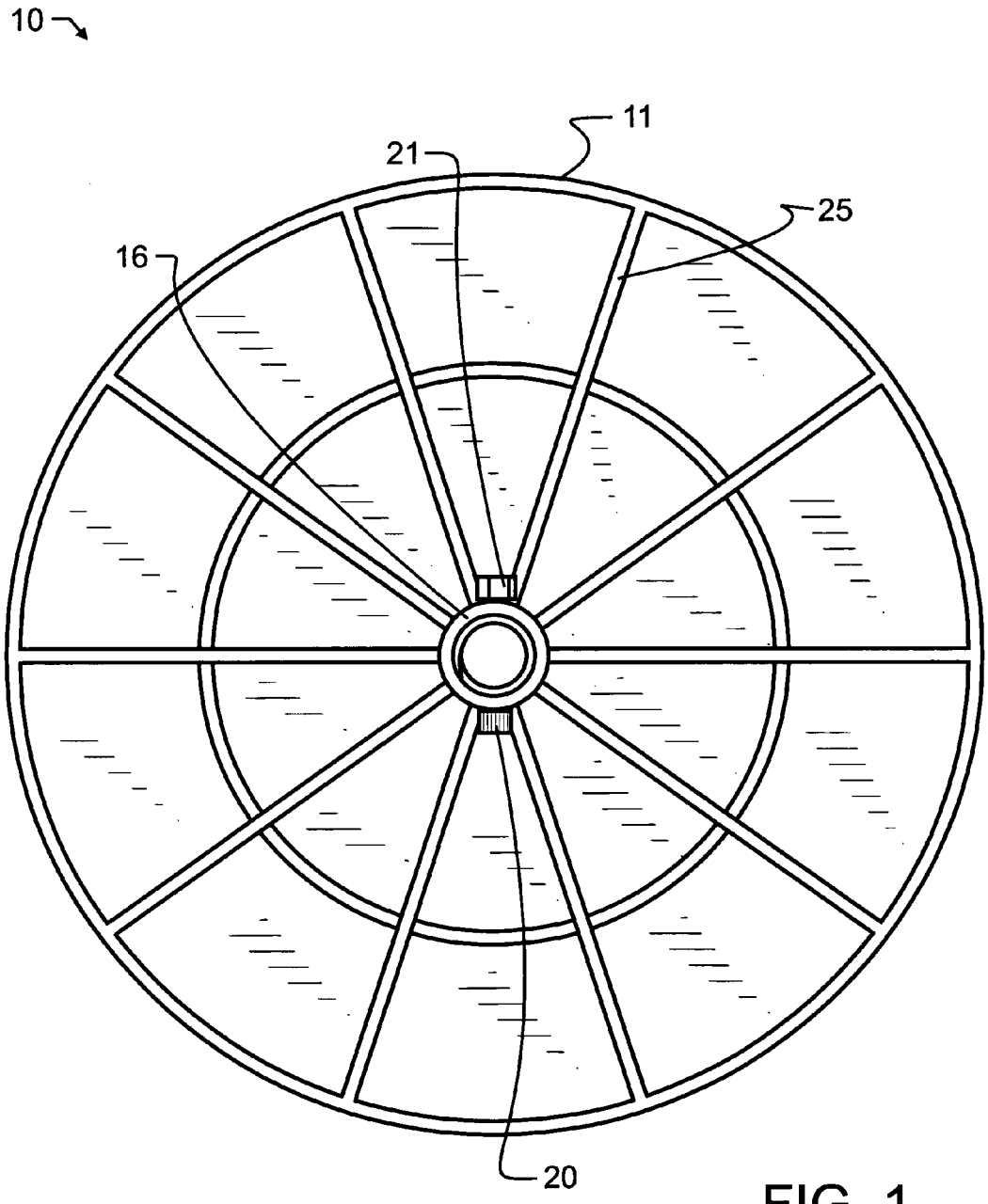
FIG. 1 illustrates a preferred embodiment symmetrical wall sander designed in accord with the teachings of the present invention from top plan view.
Figure 2:
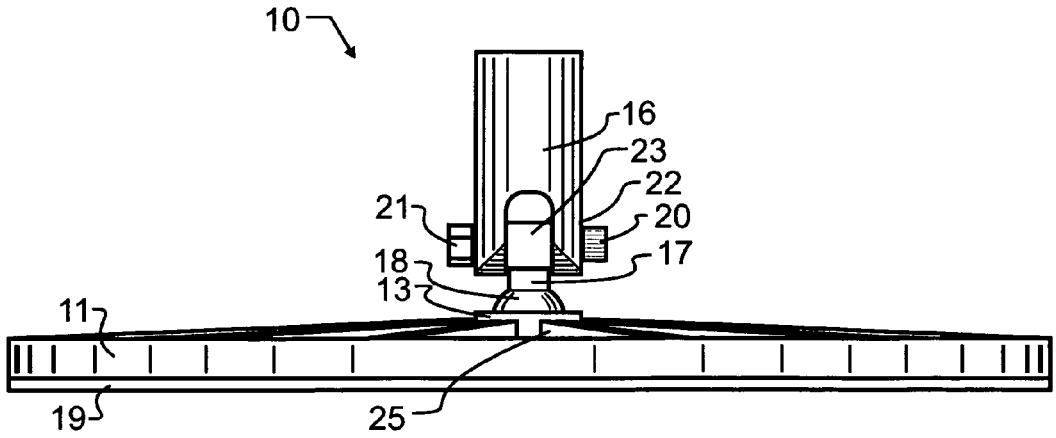
FIG. 2 illustrates the preferred embodiment symmetrical wall sander of FIG. 1 from side plan view.

The invention is manifested, for exemplary purposes as required by the statutes, in a first preferred embodiment symmetrical wall sander 10 illustrated in FIGS. 1 and 2. Symmetrical wall sander 10 includes disc-shaped sanding block 1. On one major generally planar face of sanding block 1, a pressure-adhesive, hook-and-loop or otherwise fastened sandpaper 19 is mounted. Additional intervening layers of foam, padding, cushioning or other suitable composition may additionally be provided as is known in the art, though not specifically illustrated herein for simplicity. Most preferably, formed unitarily within sanding block 11 and centrally therein is socket body 13. In order to preserve strength, while minimizing material usage and weight, a star pattern of ribs 25 emanate radially from socket body 13 to the outer perimeter of sanding block 11.

Suitable for pivotal coupling within socket body 13 is ball 18. The combination of socket body 13 and ball 18 forms a ball and socket pivotal coupling. A neck 17 is coupled to ball 18, and extends away from sanding block 11, terminating at pivot 23. Handle holder 16 has a bifurcated end 22 which surrounds pivot 23 on two sides thereof, and is retained thereto using bolt 20 and nut 21.

As may be apparent, bolt 20 and nut 21 pass through holes in both the bifurcated end 22 of handle holder 16 and through a hole in pivot 23. As long as bolt 20 is not overly tightened against nut 21, handle 16 will pivot about the axis defined by bolt 20, and therefore about pivot 23.

As may be more apparent from FIG. 2, ball 18 and socket body 13 form a coupling which permits a substantial range of motion, approximating one-third of a sphere. The exact range of motion will be dependent upon the various sizes of components used, but is limited by the imminent interference that will occur between neck 17 and socket body 13 as the longitudinal axis of neck 17 is brought to be more nearly parallel with sandpaper 19. Pivot 23 is provided to extend the range of motion of handle coupling 16 about socket body 13. More particularly, pivot 23 will enable a sander to swivel handle coupling 16 through a range of positions which exceeds that of a hemisphere.

The combination of disc-shaped sanding block 11 with ball 18 and socket body 13 provides benefit which has not heretofore been realized in the art of wall sanding. More particularly, when a person prepares to use symmetrical wall sander 10, the person will lift symmetrical wall sander 10 up to the wall to be worked upon. Hand motions, which are coupled through handle coupling 16 ultimately to sandpaper 19, will then move sanding block 11 about on the wall surface. Whether unintentionally or by intent, if anything causes one part of the surface of sandpaper 19 to grab upon the wall, such as a bump or the like or any other irregularity, the remainder of sanding block 11 will spin about with only minimal disturbance, owing to the rotation about the pad center permitted by ball 18 and socket body 13. Because of the substantially smooth and continuous perimeter of sanding block 1, which is round in the most preferred embodiment, there will be no concentration of force upon a corner of the sanding block or pad during such rotation, and there will not, therefore, be any risk of flipping sanding block 11 over such that sanding block 11 would touch the wall or otherwise damage the wall. Instead, sandpaper 19 will remain continuously in contact with the wall, unless or until the operator intentionally moves sanding block 11 away from the wall.

When a corner is to be sanded, any contact with the perpendicular surface may also be freely accommodated by rotation of sanding block 11. This will occur almost as though sanding block 11 is being rolled like a wheel along the perpendicular wall, thereby permitting carefree sanding all the way into a corner. Those skilled in the art will recognize here the benefit of using a relatively non-marking and non-marring material for the fabrication of the outer perimeter of sanding block 11, since such contact might otherwise adversely alter the walls.

Manufacture of symmetrical wall sander 10 may be achieved through the fabrication of only a very limited number of individual components. With the preferred construction, there are only three components that must be produced, beyond the standard fasteners used at pivot 23. These include sanding block 11, which may be molded, cast, machined or otherwise produced as desired. The specific fabrication method utilized will depend upon ultimate production volume and other similarly well-known manufacturing considerations. However, the use of plastic in a molding process, such as injection molding, permits the formation of the preferred geometry of socket 13 and ribs 25 instantaneously with injection of plastic. The use of a plastic composition for sanding block 11 offers relatively low weight and the opportunity for selection of a non-marking material at the perimeter thereof. Regardless of the production technique, most preferably socket 13 is sized such that ball 18 may be directly pressed therein. Consequently, assembly of the individual components will only involve the pressing of ball 18 into socket body 13, followed by the placing of handle coupling bifurcated end 22 about pivot 23 and the insertion of bolt 20 there through. Finally, nut 21 will be attached upon bolt 20. The use of a socketed head bolt or the like having external grooves or similar frictional features, which are known in the fastener art and are designed to facilitate manual grasping, will permit a person to insert and tighten the components without tools, when so preferred, without extending either the head of bolt 20 or nut 21 out into any interference with other objects. If desired, to further facilitate the insertion and removal of ball 18 with respect to socket body 13, socket body 13 may further be provided with a cut or notch similar to notch 44 illustrated herein below with respect to the first alternative embodiment.

Figure 3:
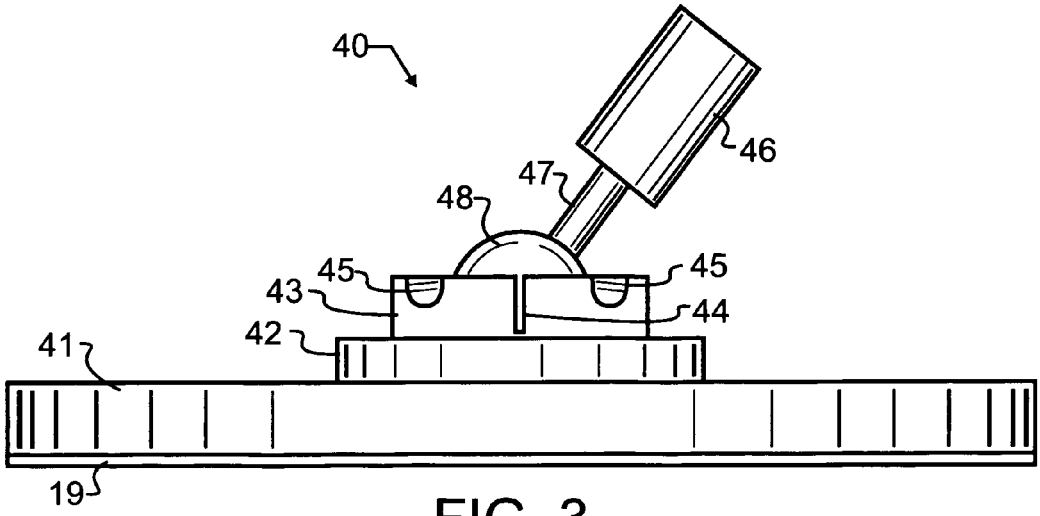
FIG. 3 illustrates a first alternative embodiment symmetrical wall sander designed in accord with the teachings of the present invention from side plan view.

In this first alternative embodiment illustrated in FIG. 3, a wall sander 40 includes block 41, cylindrical attachment plate 42 affixed to block 41, socket body 43 extending from attachment plate 42, insertion and removal notch 44 cut or formed in socket body 43, additional grooves or cut-outs 45 formed by removal or pre-design of material from socket body 43, and a handle holder 46 attached through neck 47 to ball 48. Ball 48 moves pivotally within a socket created by socket body 43. In this first alternative embodiment, handle holder 46 has a range of motion approximating more than one-half of a sphere, dependent upon the various sizes of components and limited only by the imminent interference that will generally occur between neck 47 and socket body 43 in the proximity of cut-outs 45 as the longitudinal axis of neck 47 is brought to be more nearly parallel with the surface of block 41. Attachment of ball 48 involves the simple pressing of ball 48 into socket body 43, an action which is permitted by a force-created flexure of removal notch 44 which in turn effectively increases the opening of socket body 43. As may be evident from FIG. 3, the size and placement of cut-outs 45 will determine how readily and to what extent neck 47 may pivot in a direction close to parallel with the plane defined by block 41. While larger cut-outs will more readily permit extensive pivoting of ball 48 within socket body 43, too many cut-outs which are too large may in turn jeopardize the holding power of socket 43. Furthermore, the movement of neck 47 within cut-outs 45 will restrict the relative rotation of block 41 with respect to neck 47, thereby defeating the desirable pivoting between ball 48 and socket body 43. Consequently, in this embodiment some suitable compromise must be made by the product designer at the time of construction.

While necks 17, 47 are illustrated as being straight, along the axis of the elongate handle defined by the axis of handle couplings 16, 46, necks 17 or 47 may alternatively be angled. Such angling will permit the handle to be used closer to a wall and act as an alternative to pivot 23. The angling of necks 17, 47 will, however, force the operator to observe the proper orientation of the neck to the wall, and will therefore also be an inconvenience at times.

Another consideration of the preferred embodiments is the strength of retention between the ball and socket. Pivot 23 permits the handle to be moved without applying a separating force between ball 18 and socket 13, at nearly any angle of use. Without pivot 23, it is possible to apply forces to the handle at an angle which will more likely cause the separation. Alternatively, it is also possible to include additional features known in the art of coupling which would prevent such separation. Various clips, pins, threaded caps and the like are known to provide positive means to prevent separation of the ball from the socket, and may be incorporated herein.

From these figures, several additional features and options become more apparent. First of all, symmetrical wall sanders 10 and 40 designed in accord with the teachings of the invention may be manufactured from a variety of materials, including metals, resins and plastics, ceramics or cementitious materials, or even combinations or composites of the above. The specific material used may vary, though special benefits are attainable if several important factors are taken into consideration. The symmetrical wall sanders will preferably be sufficiently light to enable satisfactory supporting and manipulation for extended periods. By using fewer and more readily separable components, such as illustrated in the preferred symmetrical wall sanders, ease of production, assembly, repair, parts storage and inventorying, and replacement may all be facilitated. The symmetrical sander blocks 11, 41 in the embodiments illustrated herein may typically be fabricated from aluminum or plastic, upon which a pressure-adhesive, hook-and-loop or otherwise fastened sandpaper 19 is mounted, with or without intervening layers, padding or cushioning.

Most preferably, a symmetrical sander such as illustrated herein will also be weather resistant and sufficiently durable to withstand the particular climate and environment for the intended application, including temperature and humidity as might be encountered and any forces that may be applied that could tend to fracture or shear each of the components. Additionally, ease of cleaning and resistance to abrasion from plaster or drywall dust and the like is preferable. The most preferred materials for sockets 13, 43 and attachment plate 42 are resins, which may or may not include various reinforcing fibers or particles, and other ingredients or fillers known to enhance the properties and weather resistance of the composition and resulting product. The resins will, where appropriate, be modified to have adequate resistance to environment, and are accompanied by low cost and ready manufacture to custom geometries. In addition, many of these resins, such as polyethylene, polypropylene, nylon, and other polyamides, polyimides, co-polymers and other materials too numerous to specifically mention, will also offer substantial lubricity, strength, and are non-marring, all while having a resistance to abrasion. As is known in the polymer industry, the molecular weight of the material may further be selected to enhance desirable characteristics, such as is commonly practiced with ultra-high molecular weight polyethylene or the like. It is additionally contemplated herein that various components may be formed integrally or unitarily, or may be formed as individual components for later assembly. Exemplary is the combination of block 41, base 42, and socket 43, which may be formed as several individual components or may be formed as one single molding or casting, the exact manufacturing method and combination of subassemblies or unitary construction not being critical to the performance and successful operation of the invention.

Where equivalent components are known in the industry to which the components is associated, those components are understood to be incorporated herein. For example, while a ball and socket is preferred herein for coupling handle to sanding pad, owing to the relative simplicity and standard geometries, those familiar with hardware couplings will recognize that there are other structures that may be used that offer the same degrees of freedom offered by the ball and socket. Pivotal motion about a single point, which permits rotation about any axis of orientation between handle and sanding pad, is the most preferred operation, and the ball and socket combined with pivot is simply the most preferred, but not only, way of obtaining this preferred operation.

A variety of shapes and designs have been contemplated for each of the preferred embodiments illustrated herein. The round shape of the sanding blocks 11, 41 is most preferred, since this geometry provides the most consistent resistance to tipping, regardless of direction of travel and force applied to sandpaper 19. However, other geometric shapes and designs, even including artistic shapes and simulations may be constructed. The materials used for a particular design may be chosen not only based upon the aforementioned factors such as weather resistance and weight, but may also factor in the particular artistic design.

While the foregoing details what is felt to be the preferred and additional alternative embodiments of the invention, no material limitations to the scope of the claimed invention are intended. The possible variants that would be possible from a reading of the present disclosure are too many in number for individual listings herein, though they are understood to be included in the present invention. Further, features and design alternatives that would be obvious to one of ordinary skill in the art are considered to be incorporated herein. The scope of the invention is set forth and particularly described in the claims herein below.

We claim:

1. In combination:

a sanding block having at least one sanding surface with a generally round perimeter;

a ball;

a socket coupled to said ball and operative therewith as a first pivoting joint, said socket further firmly coupled to said sanding block;

a handle coupling operative to couple with an elongated pole for manipulation by a person;

a neck having a transverse cross-section smaller than a diameter of said ball and smaller than a transverse cross-section of said handle coupling, said neck rigidly coupling said handle coupling to said ball; and castellations within said socket, each of size comparable to said neck and suitable to engage said neck at a limit of angular position with respect to said socket, said neck having a full angular range of motion extending primarily outside of said castellations, said castellations permitting more degrees of freedom between said socket and said handle coupling, while simultaneously permitting said neck to be locked relative to said socket by engaging said neck with at least one of said castellations at said limit of angular position.

2. The combination of claim 1 wherein said at least one sanding surface is generally planar.

3. The combination of claim 2 wherein said sanding block is generally disc-shaped.

4. The combination of claim 1 wherein said ball is readily dislocated from said socket.

5. The combination of claim 4 further comprising a notch in said socket to permit said socket to expand adjacent an opening therein, said ball coupled with said socket, operated therein, and removed therefrom repeatedly.

6. A wall sander comprising:

an elongated pole;

a handle receiver coupled to said elongated pole;

a generally planar sanding plate operative to support sanding paper thereon and having a generally circular perimeter;

a ball and socket joint pivotally coupling said handle receiver to said generally planar sanding plate about a single point of rotation and thereby permitting relative rotation therebetween about an axis of any orientation;

a neck having a transverse cross-section smaller than a diameter of said ball and smaller than a transverse cross-section of said handle receiver, said neck rigidly coupling said handle receiver to said ball; and castellations within said socket suitable to engage said neck at a limit of angular position with respect to said socket, said neck having a full angular range of motion extending primarily outside of said castellations, said castellations permitting to more degrees of freedom between said generally planar sanding plate and said handle receiver, while simultaneously permitting said neck to be locked relative to said socket by engaging said neck with at least one of said castellations at said limit of angular position.

7. The wall sander of claim 6, wherein said ball and socket are readily dislocatable from each other.

8. The wall sander of claim 7, further comprising a notch in said socket to permit said socket to expand adjacent an opening therein, said ball coupled with said socket, operated therein, and removed therefrom repeatedly.

9. A hand-manipulated wall sanding apparatus comprising:

a sandpaper support having a substantially smooth and continuous perimeter;

a hand-held extension; and a means comprising a socket, a ball readily dislocatable from said socket, and a neck having a transverse cross-section smaller than a diameter of said ball and smaller than a transverse cross-section of said hand-held extension, said neck rigidly coupling said hand-held extension to said ball for permitting both rotary and angular translation of said sandpaper support about said extension, said socket having a base coupled to said sandpaper support, an opening distal to said base operatively receiving said ball, and having a plurality of cut-outs in said socket adjacent said opening into which said neck may operatively pass, said neck having a full angular range of motion extending primarily outside of said cut-outs, said cut-outs permitting more degrees of freedom between said socket and said hand-held extension, while simultaneously permitting said neck to be locked relative to said socket by engaging said neck with at least one of said castellations at said limit of angular position; and a notch in said socket extending from said opening towards said sandpaper support, to permit said socket to expand adjacent said opening, said ball coupled with said socket, operated therein, and removed therefrom repeatedly.

* * * * *